United States Patent [19]

Calvert

[11] 3,955,748

[45] May 11, 1976

[54] PANEL INTERLOCKING MEANS

[75] Inventor: Rodney K. Calvert, Dunwoody, Ga.

[73] Assignee: The Mead Corporation, Dayton, Ohio

[22] Filed: Mar. 21, 1975

[21] Appl. No.: 560,956

[52] U.S. Cl. ..... 229/44 R; 229/39 R
[51] Int. Cl.² ..... B65Q 5/66
[58] Field of Search ..... 229/43, 44 R, 45, 37, 229/39

[56] References Cited

UNITED STATES PATENTS

| | | | |
|---|---|---|---|
| 2,316,362 | 4/1943 | Poe | 229/45 |
| 2,572,159 | 10/1951 | Kells et al. | 229/45 |
| 2,667,297 | 1/1954 | McReary | 229/44 R |
| 2,777,630 | 1/1957 | McBerger | 229/45 |
| 3,019,957 | 2/1962 | Palmer | 229/45 |
| 3,201,026 | 8/1965 | Travis et al. | 229/45 |
| 3,206,095 | 9/1965 | Stegner | 229/44 R |
| 3,326,447 | 6/1967 | Williamson | 229/45 |
| 3,337,116 | 8/1967 | Nowak | 229/45 |
| 3,827,624 | 8/1974 | Pogliotti | 229/44 R |

*Primary Examiner*—William Price
*Assistant Examiner*—Bruce H. Bernstein
*Attorney, Agent, or Firm*—Walter M. Rodgers; Walter A. Rodgers

[57] ABSTRACT

An article carrier having top lap panels, bottom and side walls interconnected to form a tubular structure is provided with end closure means in the form of end panels hinged to each end edge of each side wall, the panels being folded into overlapping relationship and being secured together by interlocking means which comprises at least one locking aperture formed in one end panel at each end of the carrier and arranged to cooperate with a corresponding locking tab foldably joined to the other end panel at each end of the carrier and having an integral locking toe and an integral locking heel extending in opposite directions, the locking heel and locking toe being arranged to be inserted into the locking aperture, and the locking toe being of a configuration different from that of the locking aperture to allow an amount of overlap while simultaneously allowing the extremity of the locking toe to clear the corresponding part of the locking aperture thereby to fold the locking tab along a longitudinal fold line.

8 Claims, 7 Drawing Figures

PANEL INTERLOCKING MEANS

Panel interlocking means is known which comprises a so-called heel and toe arrangement inserted into a locking aperture thereby interconnecting two panels. Historically this type of panel interlocking means has been utilized with top closures for light duty carriers requiring very little strength in the area of the lock. In addition this type of interlocking means has been utilized in so-called wraparound article carriers which do not require end closure means. In order to form this known type of locking arrangement, a portion of the toe must be folded in a transverse direction in order to insert it into the corresponding aperture. This procedure tends to weaken the lock thereby making it very undesirable for packages requiring strength between the locked panels. Such application of a heel and toe type lock is feasible only because the packaged articles are disposed in firm engagement with the toe and heel and thus prevent inadvertent release of the lock. Where strength is required and where the packaged items do not aid in holding the lock in locked condition, known heel and toe locks are not satisfactory.

According to this invention interlocking means for securing two panels together in overlapping relation is provided and comprises a locking tab foldably joined to one panel and including a locking toe and locking heel integral with the locking tab, a locking aperture formed in the other panel and having a locking edge for engaging the locking heel, and the locking toe being of a configuration which is different from the edge of the locking aperture remote from the locking edge so that during formation of the lock the locking toe engages a corresponding part of the other panel in overlapping relation while simultaneously the extremity of the locking toe clears the corresponding part of the locking aperture thereby to fold the locking tab along a longitudinal fold line without substantial transverse bending and the resulting weakening of the locking tab.

For a better understanding of the invention, reference may be had to the following detailed description taken in conjunction with the accompanying drawings in which FIG. 1 is a perspective view of an article carrier having end panel closure means formed according to this invention;

FIG. 6 is a crosssectional view of a panel interlocking means taken along line 6—6 in FIG. 5; and in which

Figure 1:
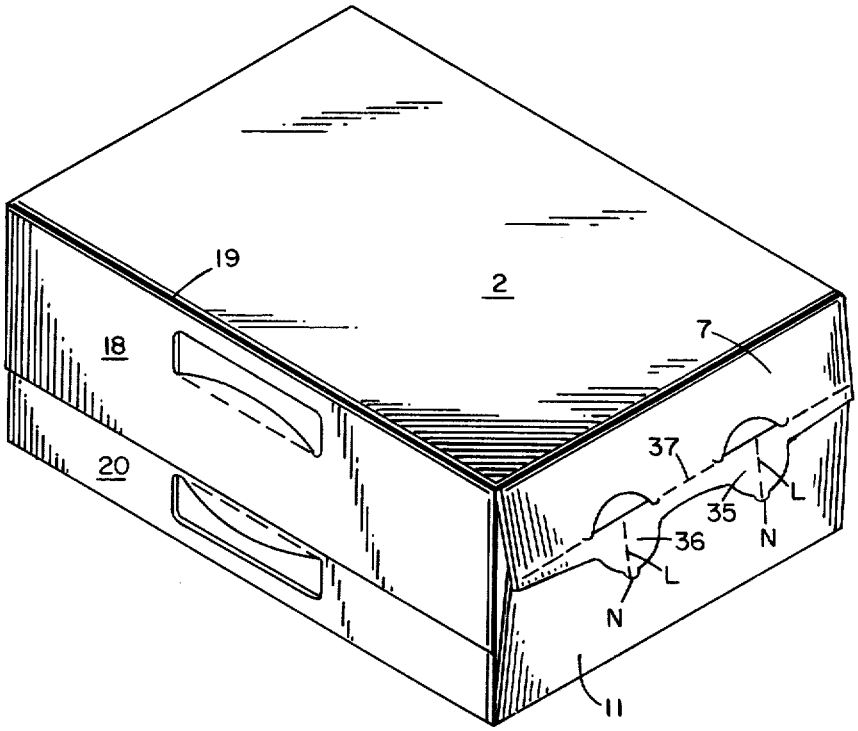

In the drawings the numeral 1 designates the bottom wall of the carrier. Side wall 2 is foldably joined to bottom wall 1 along fold line 3 and side wall 4 is foldably joined to bottom wall 1 along fold line 5. End wall panels 6 and 7 are respectively joined to side wall 2 along fold lines 8 and 9. Similarly, end wall panels 10 and 11 are foldably joined respectively to side wall 4 along fold lines 12 and 13. End closure flaps 14 and 15 are respectively joined to bottom wall 1 along fold lines 16 and 17. Top lap panel 18 is foldably joined to side wall 2 along fold line 19 and top lap panel 20 is foldably joined to side wall 4 along fold line 21. End closure flaps 22 and 23 are respectively joined to top lap panel 18 along fold lines 24 and 25. In like manner end closure flaps 26 and 27 are respectively joined to top panel 20 along lines 28 and 29. Hand carrying apertures 30 and 31 are respectively formed in top lap panels 18 and 20.

According to this invention locking tabs 32 and 33 are foldably joined to end wall panel 6 along fold line 34 and, likewise, locking tabs 35 and 36 are foldably joined to end wall panel 7 along fold line 37. Also locking apertures 38 and 39 are formed in end wall panel 10 and respectively include locking edges 40 and 41. Likewise locking apertures 42 and 43 are formed in end wall panel 11 and are provided with locking edges 44 and 45 respectively. According to this invention each locking tab is provided with a locking toe as indicated by the letter T. In addition each locking tab is provided with a locking heel as indicated by the letter H.

As shown in the drawings, a longitudinal score line designated L is incorporated into the locking tabs. While this score line is desirable for many applications of the invention, the invention is not limited thereto and for certain applications of the invention may be omitted.

Figure 2:
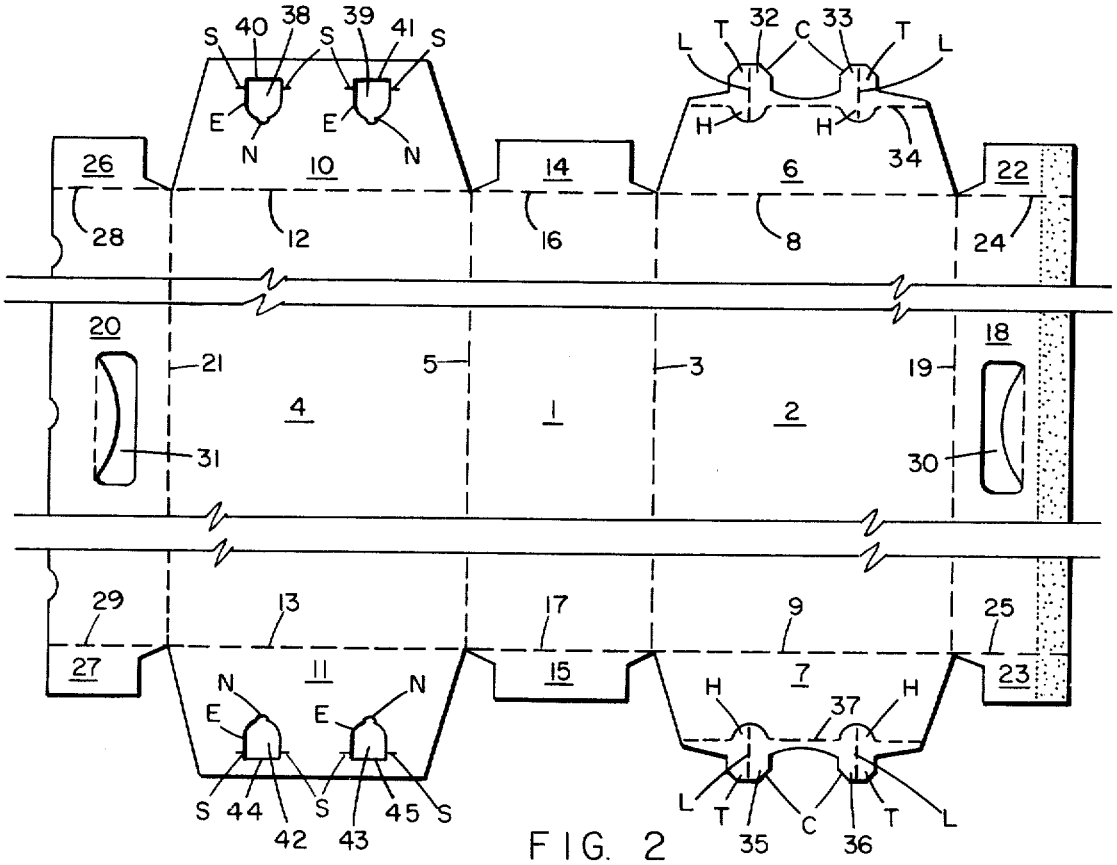
FIG. 2 is a plan view of a blank from which the carrier shown in FIG. 1 is formed with portions thereof removed.
Figure 3:
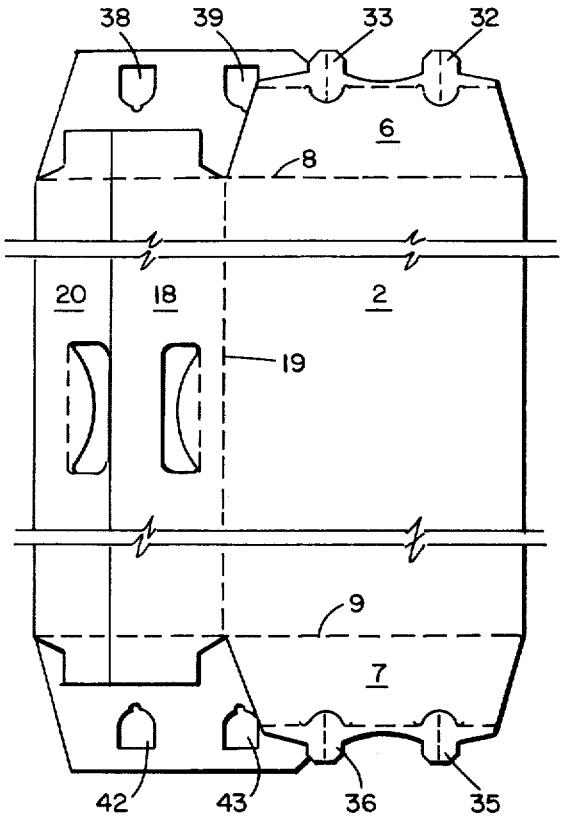
FIG. 3 depicts a completed carrier in collapsed condition with portions thereof removed.

In order to form the carrier blank as shown in FIG. 2 into the collapsed condition as shown in FIG. 3, it is simply necessary to first fold top lap panel 20 upwardly and to the right along fold line 21. Thereafter an application of glue is applied to top lap panel 18 as indicated by stippling in FIG. 2. Finally the portion of the carrier blank to the right of fold line 3 is elevated and folded to the left into the position depicted in FIG. 3. This operation secures the top lap panels together so that loading may be effected through the ends after the carrier is manipulated into set up open ended condition.

Figure 4:
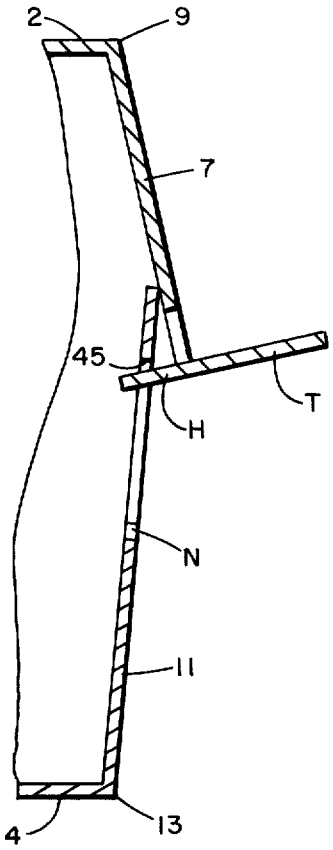
FIG. 4 is an enlarged cross-sectional view depicting an intermediate stage in the forming of panel interlocking means according to this invention.

In order to form the completed article carrier appropriate for the reception of primary packages, the collapsed carrier, as shown in FIG. 3, is opened by forming machinery and assumes a generally rectangular shape with both ends of the carrier in the open position. In order to close the ends of the carrier, end closure flaps 14, 15, 22, 23, 26 and 27 are folded inwardly into a position perpendicular to bottom panel 1 and top lap panels 18 and 20. Then end wall panels 10 and 11 are folded into a position perpendicular to side walls 2 and 4. As shown in FIG. 4 end wall panels 6 and 7 are then folded downwardly while at the same time locking tabs 32 and 33 are folded upwardly along fold line 34 and likewise locking tabs 35 and 36 are folded upwardly along fold line 37. Subsequently the locking heel H of each locking tab 32, 33, 35 and 36 is swung into abutting overlapping engagement with corresponding locking edges 40, 41, 44 and 45 as the locking heels are inserted into the locking aperture. Thereafter an appropriate machine element pushes locking toe T of each locking tab into the corresponding locking aperture and into overlapping engagement with a portion of the locking aperture as shown in FIG. 5.

Conventional heel and toe type locking arrangements for interconnecting two panels are ordinarily formed by first folding a locking tab out of the plane of the panel to which it is foldably joined and subsequently by inserting the heel portion of the locking tab into a locking aperture formed in the other panel. Following this operation and in accordance with the prior art, the locking toe is folded toward the locking aperture and is simultaneously folded along a transverse fold line which enables the locking toe to enter the locking aperture. After the lock is completed, the locking toe is folded back into the plane of the locking tab and, when thus formed, is susceptible to release if any significant stress is applied because the locking toe is already conditioned to bend along the transverse fold line thereby to release the lock.

According to this invention the locking toe is constructed and manipulated in such a way that transverse folding and the resulting weakening of the locking tab is prevented. Instead, and in accordance with a feature of this invention, the locking toe is forced to bend along a horizontal rather than a transverse fold line and such bending does not tend to weaken the lock. In order to insure bending along a longitudinal fold line, clearance space is provided at the extremity of the locking tab which allows the extremity of the locking tab to swing into locked condition without engaging medial part of the end edge of the locking aperture. Folding of the locking toe along a longitudinal fold line is effected by a machine element which engages the locking toe along a longitudinal generally medial portion to force the locking toe through the locking aperture. Furthermore the locking toe is wider than the corresponding dimension of the locking aperture at the outer end thereof so that prior and subsequent to locking the locking toe overlaps certain edge portions of the locking aperture on the outside of the panel 11 and subsequently on the inside thereof. Thus during formation of the lock the locking machine element forces the locking toe to bend along a longitudinal fold line and upon completion of the lock allows the side edges of the locking toe to spring back into face contacting engagement with the adjacent corresponding edge portions of the locking aperture. Thus the lock is formed and secured in locked condition without weakening the locking tab in a direction which facilitates unlocking. Therefore according to a principal feature of the invention a heel and toe type lock is provided which is capable of withstanding substantial stress.

Figure 5:
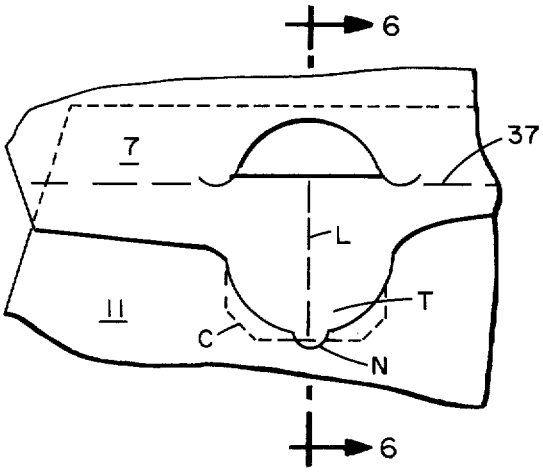
FIG. 5 is a view of panel interlocking means formed according to this invention.
Figure 6:
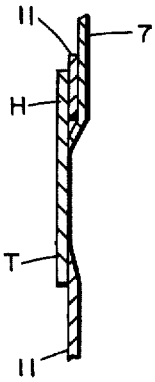

From FIG. 5 it is clear that the outer truncated corners of the locking tab designated at C overlie the adjacent portions of the locking aperture. Furthermore from FIG. 5 it is apparent that the clearance notch N, which forms a portion of the edge of the locking aperture, establishes a clearance distance at the outer end of the score line L so that when the locking tab is forced through the locking aperture to occupy the locked condition, and edge portions of the locking aperture offer no resistance whereas the corner portions C of the locking tab must be forced through the locking aperture. In order to effect a lock, the locking tab must fold longitudinally thereof along the score line L, if such a score line is used. If the score line L is not used, the function is the same.

Since the locking tab according to this invention is precluded from bending along a weakening transverse fold line, it is possible that the side edges E of the locking apertures might interfere with the formation of the lock and conceivably might damage the corresponding edges of the locking toe. It may be desirable for certain applications of the invention to form the locking apertures in such a manner that they are rendered somewhat yieldable. This may be accomplished by forming slits S which extend laterally from the locking apertures and in such manner that their inner ends coincide with the side edges of the locking aperture. While slits S for many applications of the invention are desirable, it is not necessary to use the slits S for applications of the invention where the transverse dimension of the aperture is significantly greater than the corresponding dimension of the associated locking toe.

Figure 7:
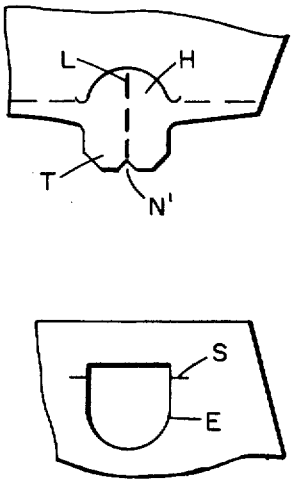
FIG. 7 depicts another version of panel interlocking means according to this invention.

FIG. 7 depicts a modification of this invention which provides a clearance notch N′ in the locking tab while at the same time eliminating the need for a clearance notch in the locking aperture. The arrangement of FIG. 7 like that of FIGS. 1–6 simply provides unobstructed clearance for the medial end portion of the locking toe while providing a locking toe and aperture configuration which force medial bending of the locking tab during a locking operation along a longitudinal line of bend and thereby prevent bending along a transverse line and the resultant weakening of the lock.

By this invention panel interlocking means is provided which allows the packaging of very large primary packages by utilizing strong locks while at the same time providing an article carrier of attractive appearance.

The embodiments of the invention in which an exclusive property or privilege is claimed are defined as follows:

1. Interlocking means for securing two panels together in overlapping relation, said interlocking means comprising a locking tab joined to one of the panels along a fold line and having an integral locking toe and an integral locking heel extending in opposite directions and generally transverse to said fold line, a locking aperture formed in the other panel and having a locking edge for engaging said locking heel upon insertion of said locking heel into said locking aperture in coordination with folding of said locking tab along said fold line out of the plane of said one panel and relative movement of the panels toward each other, and said locking toe being of a size and configuration different from said aperture so that swinging movement of said locking tab causes edge portions of said locking toe other than its medial extremity to overlap corresponding parts of said other panel while simultaneously allowing the extremity of said locking toe to clear the corresponding part of said locking aperture thereby to fold said locking tab along a longitudinal fold line during a locking operation without substantial transverse bending of said locking tab.

2. Interlocking means according to claim 1 wherein a score line extends generally medially of said locking tab.

3. Interlocking means according to claim 1 wherein at least one slit is disposed in said other panel with one end thereof in coincidence with a side edge of said locking aperture.

4. Interlocking means according to claim 1 wherein said locking toe is of generally rectangular configuration having truncated end corners.

5. Interlocking means for securing two panels together in overlapping relation, said interlocking means comprising a locking tab joined at one of the panels along a fold line and having an integral locking toe and an integral locking heel extending in opposite directions and generally transverse to said fold line, a locking aperture formed in the other panel and having a locking edge for engaging said locking heel upon insertion of said locking heel into said locking aperture in coordination with folding of said locking tab along said fold line out of the plane of said one panel and relative movement of the panels toward each other, a score line extending generally medially of said locking tab, at least one slit disposed in said other panel with one end thereof in coincidence with a side edge of said locking aperture, and said locking toe being of a size and configuration different from said aperture so that swinging movement of said locking tab causes edge portions of said locking toe other than its medial extremity to overlap corresponding parts of said other panel while simultaneously allowing the extremity of said locking toe to clear the corresponding part of said locking aperture thereby to fold said locking tab along said score line during a locking operation without substantial transverse bending of said locking toe.

6. Interlocking means for securing two panels together in overlapping relation, said interlocking means comprising a locking tab joined to one of the panels along a fold line and having an integral locking toe and an integral locking heel extending in opposite directions and generally transverse to said fold line, a locking aperture formed in the other panel and having a locking edge for engaging said locking heel upon insertion of said locking heel into said locking aperture in coordination with folding of said locking tab along said fold line out of the plane of said one panel and relative movement of the panels toward each other, and said locking toe being of a configuration which is different from the edge of said aperture remote from said locking edge so that swinging movement of said locking tab causes edges of said locking toe to overlap corresponding parts of said other panel, and a clearance notch disposed along said edge of said locking aperture remote from said locking edge for allowing the extremity of said locking toe to clear said aperture at said notch thereby to fold said locking tab along a longitudinal fold line during a locking operation without substantial transverse bending of said locking tab.

7. Interlocking means according to claim 6 wherein said edge remote from said locking edge is of an arcuate configuration.

8. Interlocking means for securing two panels together in overlapping relation, said interlocking means comprising a locking tab joined to one of the panels along a fold line and having an integral locking toe and an integral locking heel extending in opposite directions and generally transverse to said fold line, a locking aperture formed in the other panel and having a locking edge for engaging said locking heel upon insertion of said locking heel into said locking aperture in coordination with folding of said locking tab along said fold line out of the plane of said one panel and relative movement of the panels toward each other, and said locking toe being of a configuration which is different from the edge of said aperture remote from said locking edge so that swinging movement of said locking tab causes edges of said locking toe to overlap corresponding parts of said other panel, and a clearance notch disposed along the end edge of said locking toe remote from said locking heel for allowing the extremity of said locking toe to clear the corresponding part of said locking aperture thereby to fold said locking tab along a longitudinal fold line during a locking operation without substantial transverse bending of said locking tab.

* * * * *